US009377254B2

(12) United States Patent
Trovant et al.

(10) Patent No.: US 9,377,254 B2
(45) Date of Patent: Jun. 28, 2016

(54) COOLING OF CHILL MOLDS USING BAFFLES

(71) Applicant: Hatch Ltd., Mississauga (CA)

(72) Inventors: Michael Trovant, Toronto (CA); Lucas Alexander Brown, Kingston (CA); Tony Cesta, Toronto (CA); Katharine Elizabeth Stokman-Connell, Oakville (CA); Felim Patrick McCaffrey, Toronto (CA)

(73) Assignee: Hatch Ltd., Mississauga, Ontario (CA)

( * ) Notice: Subject to any disclaimer, the term of this patent is extended or adjusted under 35 U.S.C. 154(b) by 0 days.

(21) Appl. No.: 14/356,202

(22) PCT Filed: Nov. 5, 2012

(86) PCT No.: PCT/CA2012/001019
§ 371 (c)(1),
(2) Date: May 5, 2014

(87) PCT Pub. No.: WO2013/063693
PCT Pub. Date: May 10, 2013

(65) Prior Publication Data

US 2014/0352922 A1 Dec. 4, 2014

Related U.S. Application Data

(60) Provisional application No. 61/555,522, filed on Nov. 4, 2011.

(51) Int. Cl.
*B22D 15/04* (2006.01)
*B22D 30/00* (2006.01)

(Continued)

(52) U.S. Cl.
CPC ..... *F28F 13/12* (2013.01); *B22D 15/04* (2013.01); *B22D 30/00* (2013.01); *B22D 45/00* (2013.01); *B22D 47/00* (2013.01)

(58) Field of Classification Search
CPC ..... B22D 15/00; B22D 15/04; B22D 30/00; B22D 45/00; B22D 47/00
USPC ..... 164/127, 352
See application file for complete search history.

(56) References Cited

U.S. PATENT DOCUMENTS 2,864,141 A * 12/1958 Vallak ..... 249/162
3,570,583 A 3/1971 Lauener (Continued)

FOREIGN PATENT DOCUMENTS

JP 61063351 4/1986

OTHER PUBLICATIONS

International Search Report of International Patent Application No. PCT/CA2012/001019, mailed Jan. 18, 2013.

(Continued)

*Primary Examiner* — Kevin P Kerns
(74) *Attorney, Agent, or Firm* — Bereskin & Parr LLP

(57) ABSTRACT

A chill mold is used to cool molten material to form a casting. A support holds the chill mold so that a bottom of the chill mold is elevated. A baffle is arranged to divert a generally horizontal flow of cooling air upwardly to impinge the bottom of the chill mold. A plurality of chill molds may be aligned generally in a row, and at least one fan may be arranged at an end of the row to direct the flow of cooling air underneath the chill molds. The size and the vertical position of the baffles may be varied along the row, so as to generally equalize convective cooling rates among the chill molds in the row.

22 Claims, 8 Drawing Sheets

(51) Int. Cl.

| | |
|---|---|
| ***B22D 45/00*** | (2006.01) |
| ***B22D 47/00*** | (2006.01) |
| ***F28F 13/12*** | (2006.01) |

(56) References Cited

U.S. PATENT DOCUMENTS

| | | | | |
|---|---|---|---|---|
| 4,105,060 | A * | 8/1978 | Hauke | 164/130 |
| 6,145,577 | A | 11/2000 | Hunter et al. | |
| 6,422,295 | B1 * | 7/2002 | Larsson et al. | 164/128 |
| 2002/0104596 | A1 * | 8/2002 | Crafton et al. | 148/538 |
| 2007/0131380 | A1 | 6/2007 | Wobker et al. | |

OTHER PUBLICATIONS

English Translation of the Abstract of JP61063351.

* cited by examiner

COOLING OF CHILL MOLDS USING BAFFLES

CROSS-REFERENCE TO RELATED APPLICATION

This application claims priority to U.S. Provisional Application No. 61/555,522 filed on Nov. 4, 2011, the entire contents of which are hereby incorporated herein by reference.

TECHNICAL FIELD

The present disclosure relates to an arrangement for cooling chill molds, and particularly to baffles for diverting the flow of cooling air to impinge chill molds.

BACKGROUND

The following paragraphs are not an admission that anything discussed in them is prior art or part of the knowledge of persons skilled in the art.

In some smelting operations, molten material may be cooled by forced convection to form castings. For example, at a calcium carbide smelter plant, molten calcium carbide may be tapped from a furnace at approximately 2000° C. into cast iron chill molds. In other processes, molten material may be tapped from a furnace into an intermediate transfer vessel, and subsequently poured into chill molds.

In either case, the chill molds may then be moved to a dedicated cooling area. Fans may there be used to direct flows of cooling air to cool groups of the chill molds.

SUMMARY OF THE DISCLOSURE

The following summary is intended to introduce the reader to the more detailed description that follows and not to define or limit the claimed subject matter.

In a forced convection process, such as described above, the cooling time for a chill mold may be up to 40 hours or more. Due to the relatively long cooling period for each chill mold, large cooling areas may be required to achieve satisfactory throughput, which increases both capital and operating costs. Furthermore, flow velocity from cooling fans tends to decay with distance from the fan. As a result, chill molds furthest from the fans may be subject to reduced convective cooling, requiring a longer cooling period.

According to an aspect of the present disclosure, an apparatus for cooling a molten material may include: a chill mold having a bottom and at least one sidewall rising up from the bottom defining together a vessel for holding the molten material therein to form a casting; a support having a base that holds the support generally upright on a floor surface and a frame positioned above the base adapted to receive and hold the chill mold so that the bottom is elevated relative to the base; and a baffle arranged underneath the frame and adapted to divert a generally horizontal flow of cooling air upwardly to impinge the bottom of the chill mold when supported on the frame.

The support may include a column extending between the base and the frame. The baffle may be mounted to the column. The base may be mounted to the floor surface. A vertical position of the baffle may be adjustable. A guiding surface of the baffle may be curved so that the flow of cooling air impinges the bottom generally vertically.

According to another aspect of the present disclosure, a system for cooling a molten material may include: a plurality of chill molds aligned generally in a row, each of the chill molds having a bottom and at least one sidewall defining together a vessel for holding the molten material therein to form a casting; at least one fan arranged at an end of the row, and adapted to direct a generally horizontal flow of cooling air underneath the chill molds; and a plurality of baffles arranged underneath at least a portion of the chill molds and adapted to divert the flow of cooling air upwardly to impinge the bottoms of at least some of the chill molds.

Each of the baffles may be associated with a respective one of the chill molds. The baffles may vary in size. The baffles may be progressively larger the further away the baffles are from the fan. Vertical positions of the baffles may vary. At least some of the baffles may be vertically offset from one another so that each diverts a portion of the flow of cooling air while permitting the remaining flow to pass on to the next baffle.

The at least one fan may include first and second fans arranged at respective first and second ends of the row. The first and second fans may direct respective first and second flows of cooling air in generally opposing directions. The baffles being closer to the first fan may be arranged to divert the first flow of cooling air, and the baffles being closer to the second fan may be arranged to divert the second flow of cooling air.

The system may include a plurality of supports. Each of the supports may include a base that holds the support generally upright on a floor surface, a frame positioned above the base adapted to receive and hold a respective one of the chill molds so that the bottom is elevated relative to the base, and a column extending between the base and the frame.

In another aspect of the present disclosure, a method of cooling a molten material may include: pouring the molten material in a plurality of chill molds, each of the chill molds having a bottom and at least one sidewall rising up from the bottom defining together a vessel for holding the molten material therein to form a casting; aligning the chill molds generally in a row; directing a generally horizontal flow of cooling air underneath the chill molds; and diverting the flow of cooling air upwardly so as to impinge the bottoms of at least some of the chill molds.

The step of diverting may include the flow of cooling air impinging bottoms of the chill molds generally vertically. The step of diverting may include arranging a plurality of baffles underneath some of the chill molds.

The method may further include varying a size of at least one of the baffles relative to the other baffles. The method may further include varying the size of the at least one of the baffles based on the distance of the baffle relative to a source of the flow of cooling air.

The method may further include varying a vertical position of at least one of the baffles relative to the other baffles. The step of varying may include arranging at least some of the baffles vertically offset from one another so that each diverts a portion of the flow of cooling air while permitting the remaining flow to pass on to the next baffle.

BRIEF DESCRIPTION OF THE DRAWINGS

In order that the claimed subject matter may be more fully understood, reference will be made to the accompanying drawings, in which:

DETAILED DESCRIPTION

Figure 1:
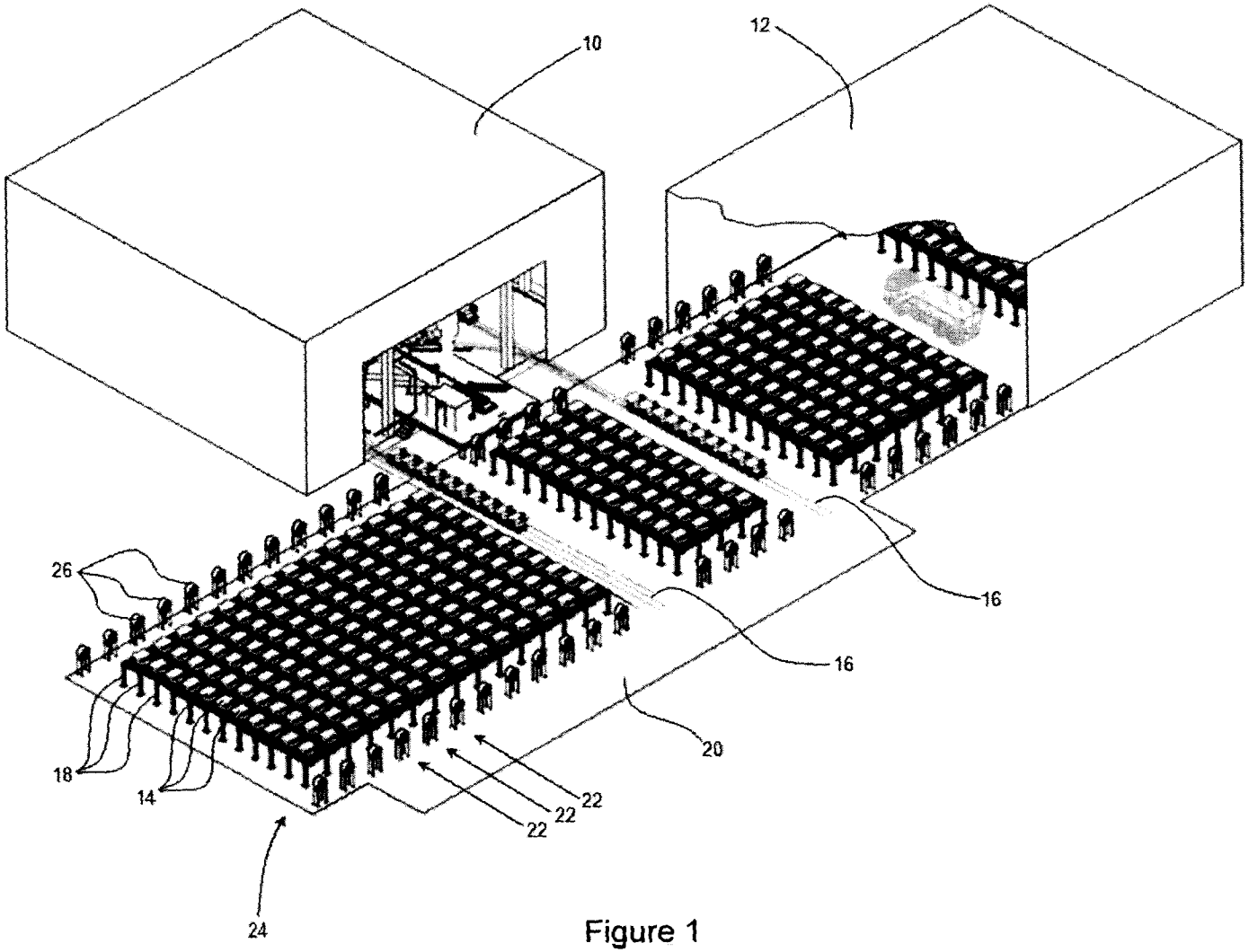
FIG. 1 is a partial cutaway, perspective view of a furnace building and a mold cooling building.

In the following description, specific details are set out to provide examples of the claimed subject matter. However, the examples described below are not intended to define or limit the claimed subject matter. It will apparent to those skilled in the art that many variations of the specific examples may be possible within the scope of the claimed subject matter.

For simplicity and clarity of illustration, where considered appropriate, reference numerals may be repeated among the figures to indicate corresponding or analogous elements or steps.

Referring to FIG. 1, an example of a smelting operation is shown to include a furnace building 10 and a mold cooling building 12. The exterior structure of the mold cooling building 12 has been partially removed to expose the interior.

In the furnace building 10, molten material may be tapped from a furnace (not shown), or otherwise poured (e.g., using an intermediate transfer vessel), into chill molds. The chill molds, identified by reference numeral 14, may then be transported from the furnace building 10 to a dedicated cooling area in the mold cooling building 12 using, for example, transport cars on rails 16.

In the mold cooling building 12, the chill molds 14 may be picked up using, for example, an overhead crane (not shown) and arranged on supports 18 so that the chill molds 14 are elevated off of a floor surface 20. As illustrated, the chill molds 14 are aligned in a series of rows 22, forming an array 24. Fans 26 located at ends of the rows 22 direct flows of cooling air at the chill molds 14. The chill molds 14 gradually cool, and the molten material therein forms castings. Once cooled, the chill molds 14 may be picked up by the overhead crane and transported elsewhere for further processing.

Figure 2:
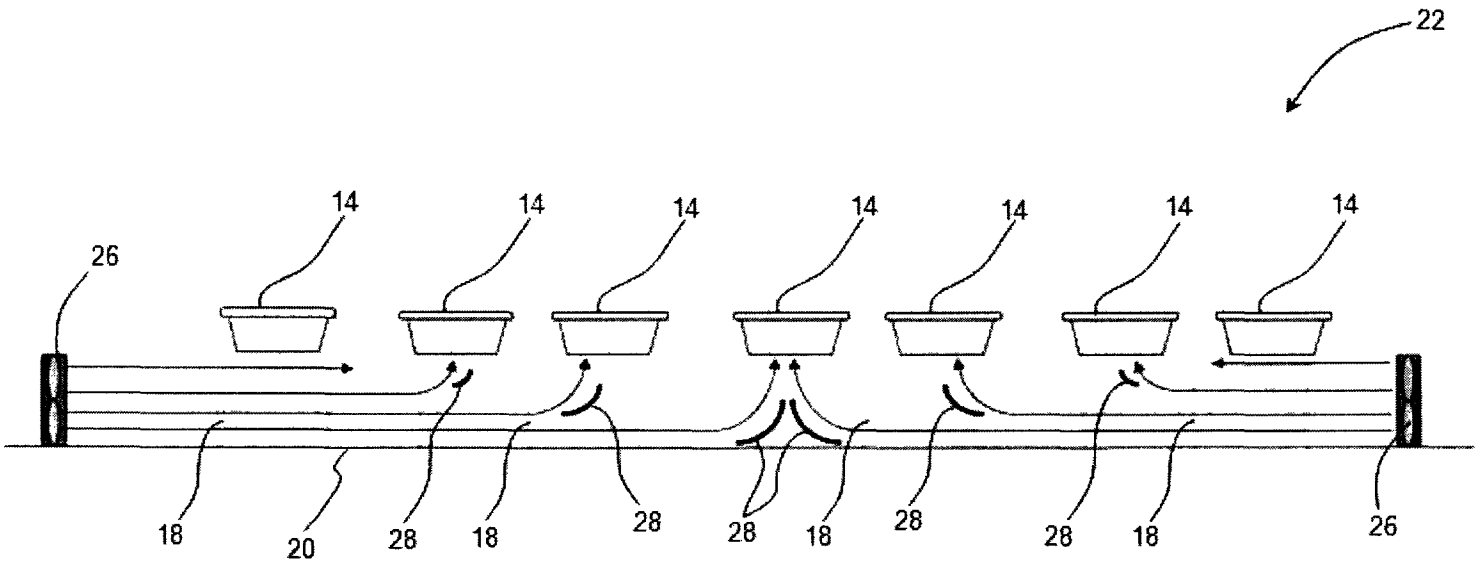
FIG. 2 is a schematic side view of a row of chill molds.

Referring now to FIG. 2, the fans 26 may be arranged at either end of the row 22, and each directs a generally horizontal flow of cooling air, in opposing directions, underneath the chill molds 14. The fans 26 are selected to provide adequate velocity of the cooling air to the chill molds 14 located roughly in the middle between the fans 26. In other examples, only one of the fans 26 may be provided at one end of the row 22. Also, although seven of the chill molds 14 are shown aligned in the row 22, it will be appreciated that the number of chill molds 14 provided in a row may vary.

Baffles 28 are arranged underneath the chill molds 14 to divert the flow of cooling air upwardly to impinge the chill molds 14. As illustrated, the baffles 28 are arranged to divert the flow of cooling air coming from the fan 26 that is the closest. Also, the baffles 28 are each shown to be associated with a particular one of the chill molds 14, whereas some of the chill molds 14 (the ones closest to the fans 26) do not have an associated baffle 28.

The supports 18 are shown as table-like structures which elevate the chill molds 14 above the floor surface 20. Although not shown in FIG. 2, it will be appreciated that bottoms of each of the chill molds 14 are mostly exposed and unobstructed by the supports 18, so that the flow of cooling air from the fans 26 may be directed upwardly to impinge the chill molds 14 without substantial interference by the supports 18.

Figure 3:
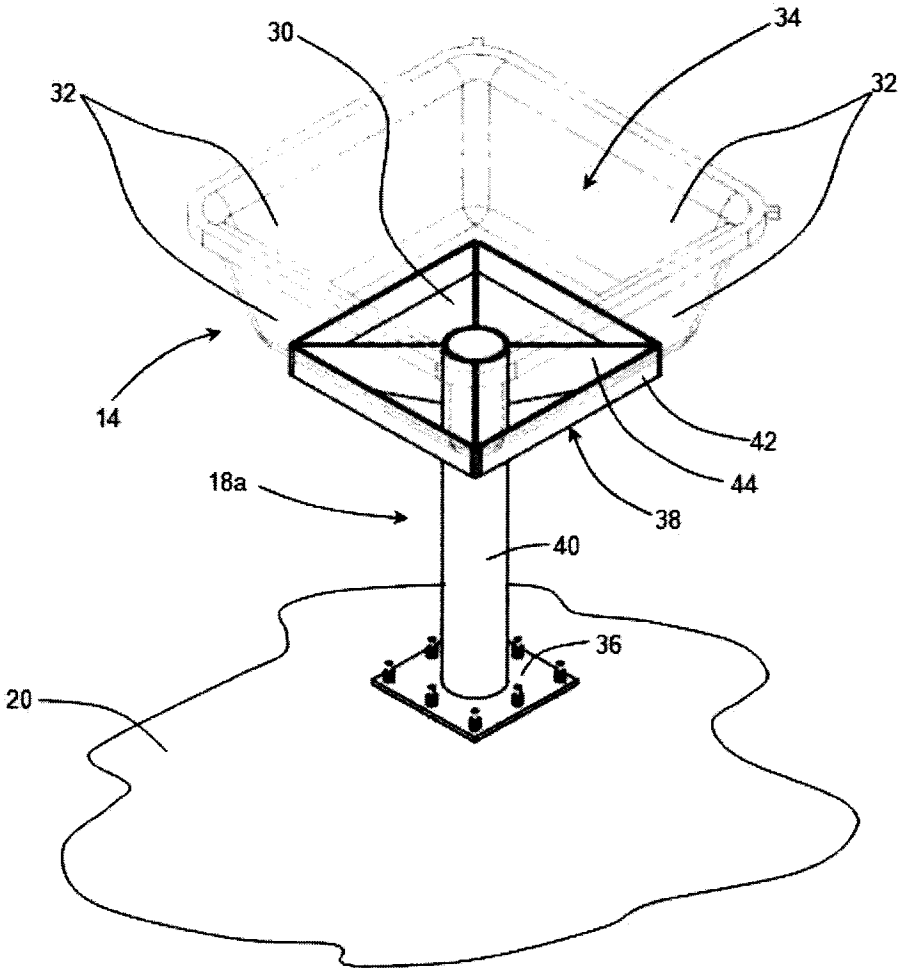
FIG. 3 is a perspective upper view of a chill mold and a support according to an example.

Referring to FIG. 3, the chill mold 14, which is shown in ghost lines to expose further details of another support 18*a*, includes a bottom 30 and sidewalls 32 rising up from the bottom 30 to form a vessel 34 for holding the molten material. During cooling, the bottom 30 of the chill mold 14 may remain significantly hotter than the sidewalls 32 for most of the cooling duration. Accordingly, as described herein, the rate of convective cooling may be accelerated by impinging the bottom 30 with cooling air, as opposed to directing cooling air at one of the sidewalls 32.

In the example illustrated, the support 18*a* includes a base 36 that holds the support 18*a* generally upright on the floor surface 20. The base 36 may be mounted to the floor surface 20 using fasteners, for example. A frame 38 is positioned above the base 36, and a column 40 extends between the base 36 and the frame 38. As illustrated, the column 40 may be generally cylindrical, and with only one of the columns 40 supporting each of the chill molds 14, so as to minimize restriction on the flow of cooling air.

The frame 38 receives and holds the chill mold 14 so that the bottom 30 is elevated relative to the base 36 and is raised off of the floor surface 20. In the example illustrated, the frame 38 includes a square-shaped outer structure 42 and cross members 44 extending between a top of the column 40 and the outer structure 42. Again, with this configuration, the bottom 30 of the chill mold 14 is mostly exposed and unobstructed by the frame 38 to minimize interference on the flow of cooling air impinging the bottom 30.

Figure 4:
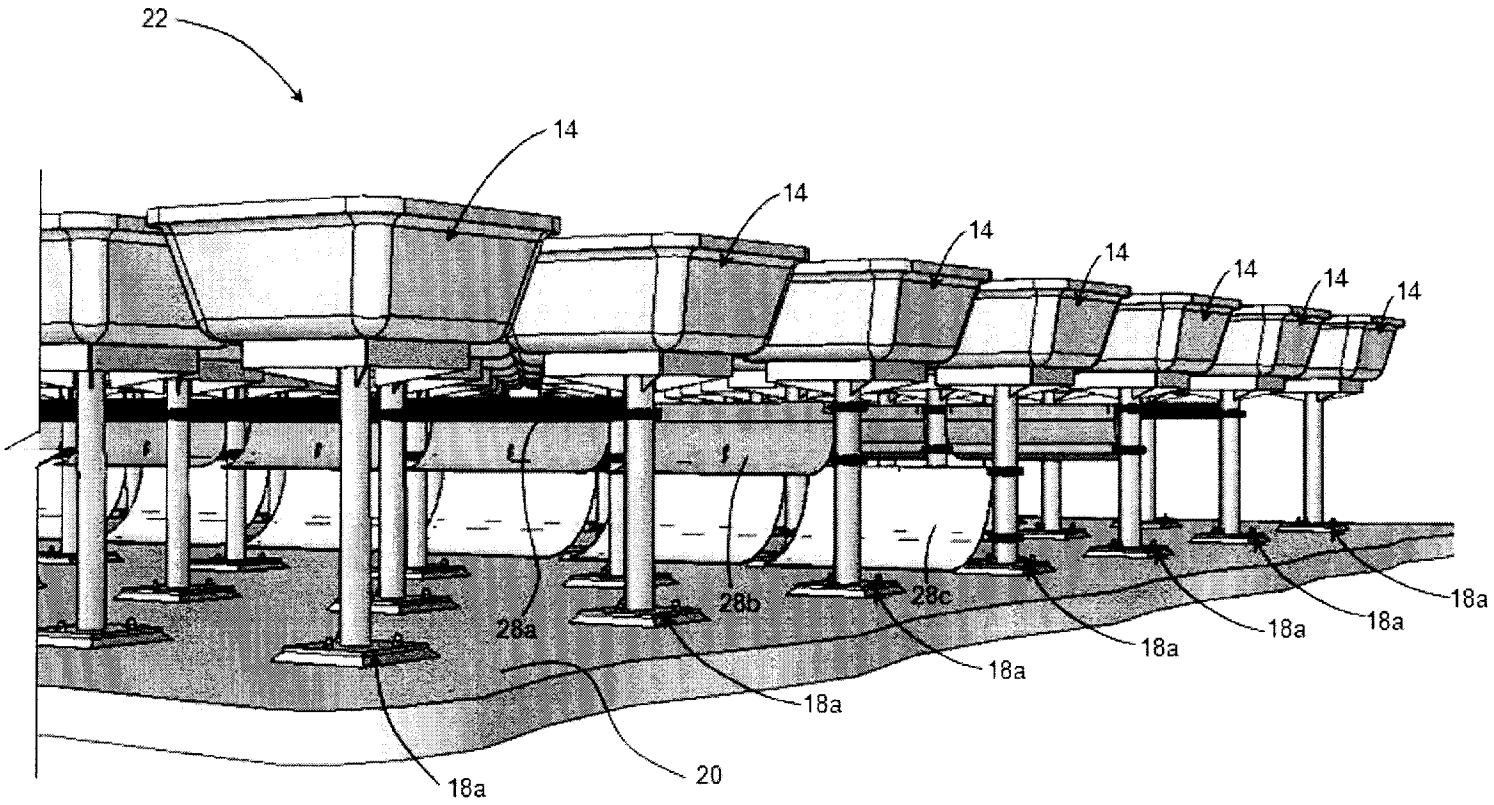
FIG. 4 is a perspective side view of a number of the chill molds and the supports of FIG. 3 aligned in a row, and with baffles.
Figure 5:
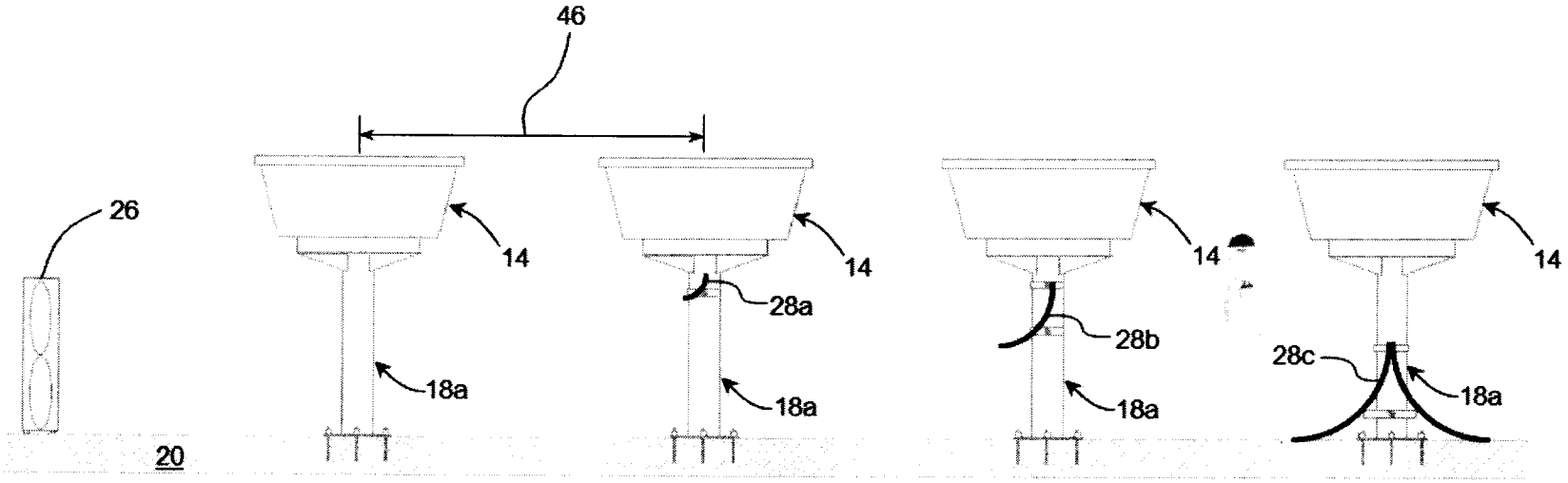
FIG. 5 is a detailed side view of some of the chill molds, the supports and the baffles of FIG. 4.

Referring now to FIGS. 4 and 5, three different baffles, identified by reference numerals 28*a*, 28*b* and 28*c*, are shown arranged underneath some of the chill molds 14 in the row 22 to divert the flow of cooling air upwardly.

In the example illustrated, the baffles 28*a*, 28*b* and 28*c* each have a guiding surface, facing the fan 26, that is curved through approximately 90° to divert the horizontal flow into a vertical direction so that the flow of cooling air impinges the bottom of the chill molds generally vertically. In some examples, each of the baffles 28*a*, 28*b* and 28*c* may consist of a relatively thin, curved plate, which may be formed of steel.

Figure 6:
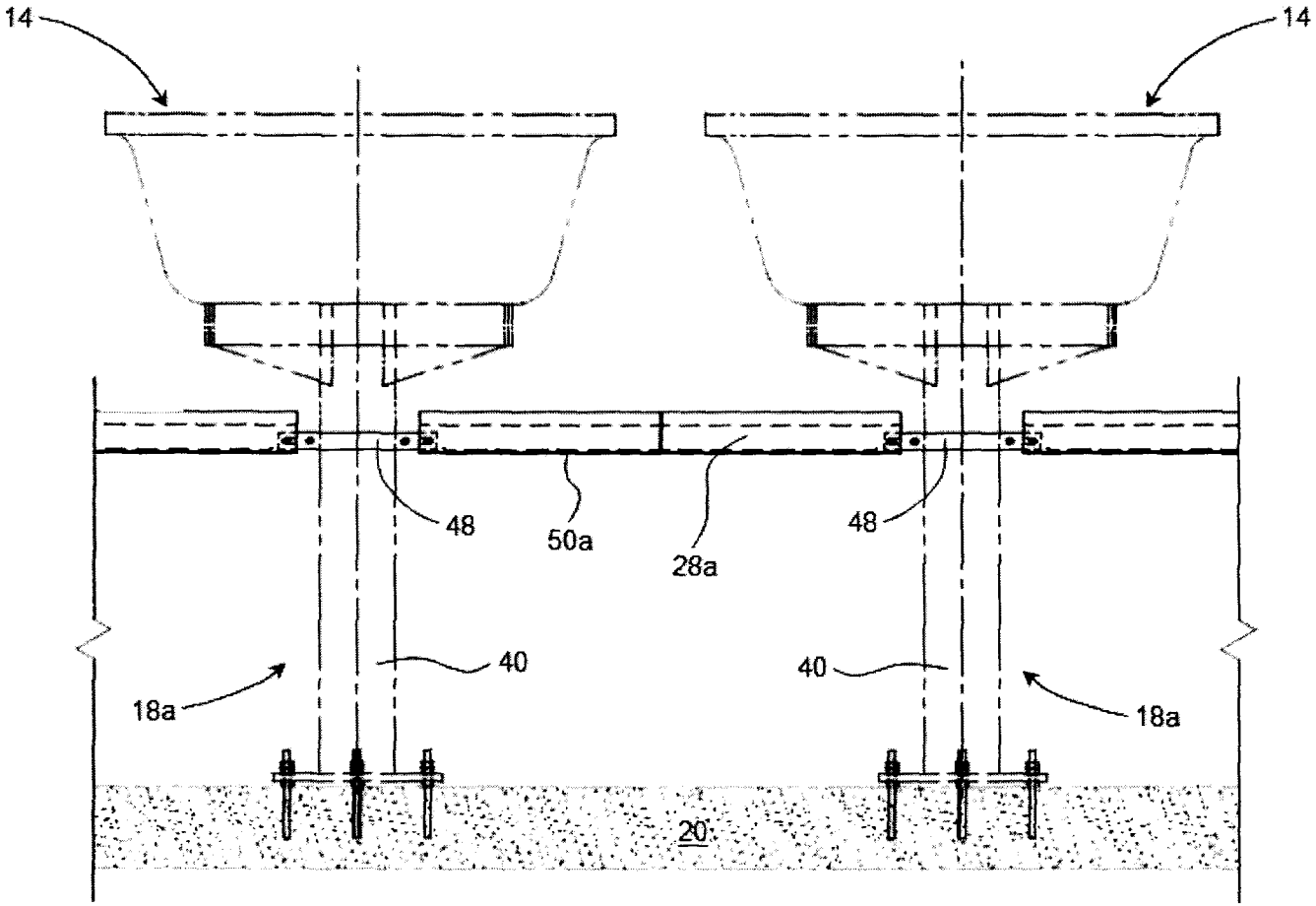
FIG. 6 is a detailed end view of some of the chill molds, the supports and a first one of the baffles of FIG. 4.
Figure 7:
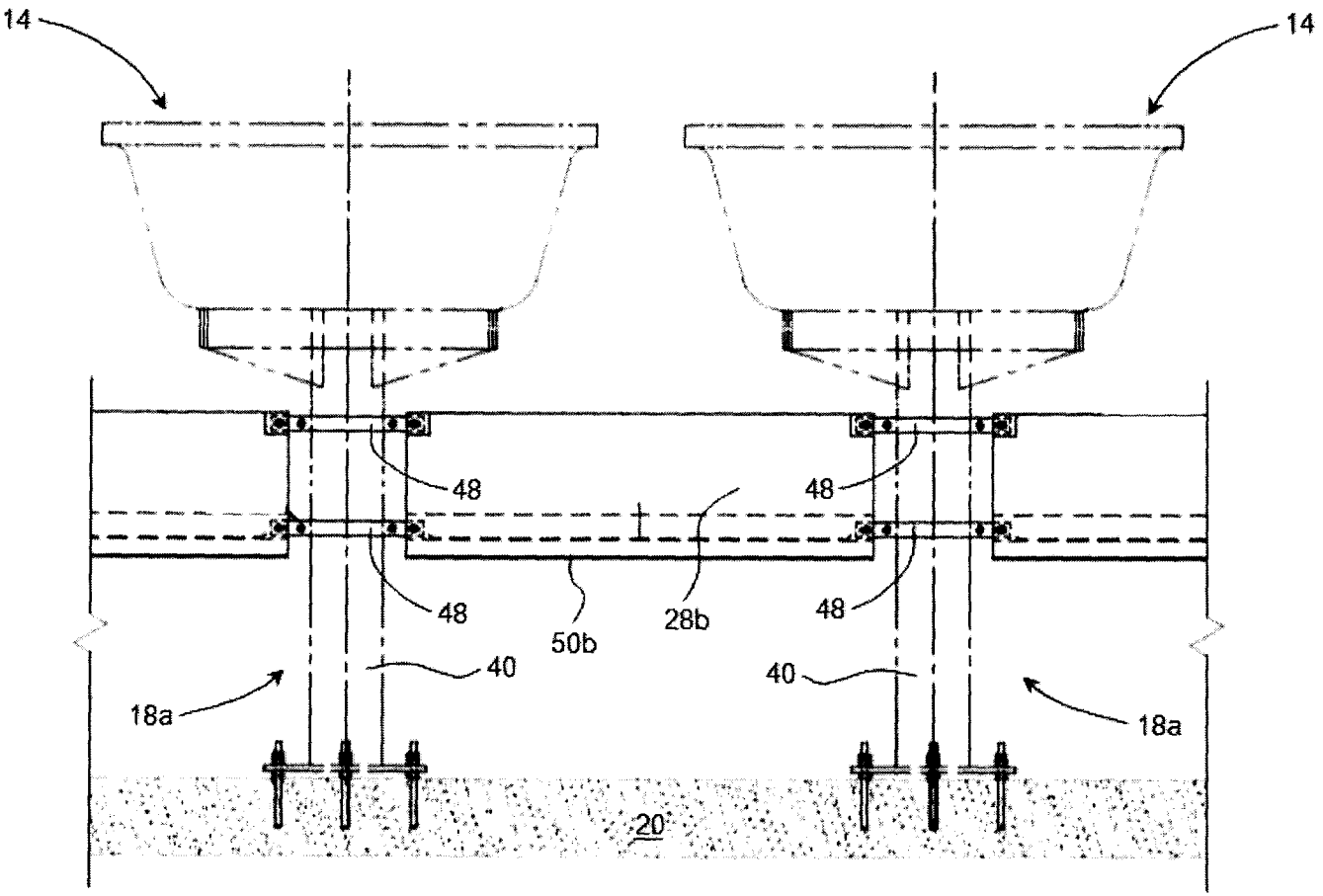
FIG. 7 is a detailed end view of some of the chill molds, the supports and a second one of the baffles of FIG. 4.
Figure 8:
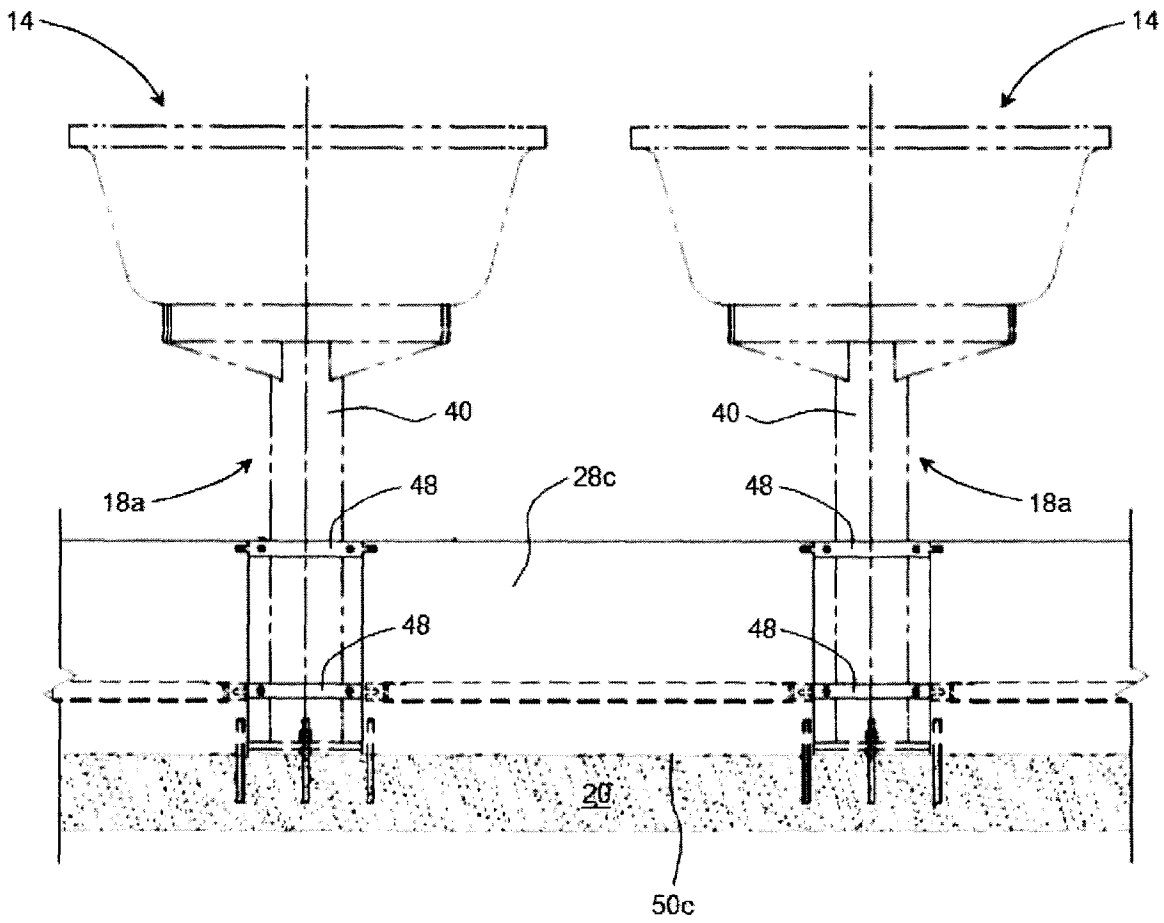
FIG. 8 is a detailed end view of some of the chill molds, the supports and a third one of the baffles of FIG. 4.

Further views of the baffles 28*a*, 28*b*, 28*c* are provided in FIGS. 6, 7 and 8, respectively.

As mentioned above, there tends to be a progressive decay in velocity as a flow of air moves away from a fan. To counteract this decay, the area of the baffles may be varied, with the largest baffle located furthest away from the fan where velocity of the cooling air is lowest.

In the example illustrated, the baffles 28*a*, 28*b*, 28*c* are progressively larger the further away they are from the fan 26. A larger area may direct proportionately more of the flow of cooling air to the chill molds 14 located further away from the fan 26, so as to generally equalize convective cooling rates among the chill molds 14 in the row 22.

For example, for illustration purposes and not intended to be limiting, if each of the chili molds 14 is 1.5 m long, 1.5 m wide and 0.9 m tall, and a center-to-center distance (identified as reference numeral 46 in FIG. 5) is 3.0 m, then the size of baffle 28*a* may be 1.8 m wide by 0.16 m tall (0.288 $m^2$), the size of the baffle 28*b* may be 1.8 m wide by 0.56 m tall (1.088 $m^2$), and the size of the baffle 28*c* may be 1.8 m wide by 0.86 m tall (1.548 $m^2$).

In the example illustrated, the baffles 28*a*, 28*b*, 28*c* are mounted to the column 40 of the supports 18*a* of adjacent rows using collars 48. The collars 48 may be adjustable so that the vertical position of the baffles 28*a*, 28*b*, 28*c* on the column 40 may be varied. For example, fasteners may be used to constrict the collars 48 to circumferentially engage the column 40 and fix its position thereon.

With continued reference to FIGS. 6, 7 and 8, a bottom edge 50*b* of the baffle 28*b* is vertically offset below a bottom edge 50*a* of the baffle 28*a*, so that the baffle 28*a* diverts a portion of the flow of cooling air while permitting the remaining flow to pass on to the baffles 28*b*, 28*c*. Similarly, a bottom edge 50*c* of the baffle 28*c* is vertically offset below a bottom edge 50*b* of the baffle 28*b*, so that the baffle 28*b* diverts a portion of the flow of cooling air while permitting the remaining flow to pass on to the baffle 28*c*.

It will be appreciated by those skilled in the art that many variations are possible within the scope of the claimed subject matter. The examples that have been described above are intended to be illustrative and not defining or limiting.

We claim:

1. An apparatus for cooling a molten material, comprising:

a chill mold having a bottom panel and at least one sidewall rising up from the bottom panel defining together a vessel for holding the molten material therein to form a casting;

a support having a base that holds the support generally upright on a floor surface and a frame positioned above the base adapted to receive and hold the chill mold so that the bottom panel is elevated relative to the base;

a fan that directs a generally horizontal flow of cooling air below the frame; and a baffle arranged underneath the frame, the baffle having an air flow guiding surface that partially faces the fan and partially faces the bottom panel of the chill mold, the guiding surface being thus adapted to divert the generally horizontal flow of cooling air upwardly to impinge on the bottom panel of the chill mold when supported on the frame.

2. The apparatus of claim 1, wherein the support comprises a column extending between the base and the frame.

3. The apparatus of claim 2, wherein the baffle is mounted to the column.

4. The apparatus of claim 1, wherein the base is mounted to the floor surface.

5. The apparatus of claim 2, wherein a vertical position of the baffle is adjustable.

6. The apparatus of claim 1, wherein the guiding surface of the baffle is curved so that the flow of cooling air impinges the bottom generally vertically.

7. A system for cooling a molten material, comprising:

a plurality of chill molds aligned generally in a row, each of the chill molds having a bottom panel and at least one sidewall defining together a vessel for holding the molten material therein to form a casting;

at least one fan arranged at an end of the row, and adapted to direct a generally horizontal flow of cooling air underneath the chill molds; and a plurality of baffles arranged underneath at least a portion of the chill molds, each of the baffles having an air flow guiding surface adapted to divert the flow of cooling air upwardly to impinge on the bottom panels of at least some of the chill molds, the guiding surface partially facing the at least one fan and partially facings a bottom panel.

8. The system of claim 7, wherein each of the baffles is associated with a respective one of the chill molds.

9. The system of claim 8, wherein the baffles vary in size.

10. The system of claim 9, wherein the baffles are progressively larger the further away the baffles are from the at least one fan.

11. The system of claim 7, wherein vertical positions of the baffles vary.

12. The system of claim 11, wherein at least some of the baffles are vertically offset from one another so that each diverts a portion of the flow of cooling air while permitting the remaining flow to pass on to the next baffle.

13. The system of claim 7, wherein the at least one fan comprises first and second fans arranged at respective first and second ends of the row, the first and second fans directing respective first and second flows of cooling air in generally opposing directions.

14. The system of claim 13, wherein the baffles being closer to the first fan are arranged to divert the first flow of cooling air, and the baffles being closer to the second fan are arranged to divert the second flow of cooling air.

15. The system of claim 7, further comprising a plurality of supports, each of the supports comprising a base that holds the support generally upright on a floor surface, a frame positioned above the base adapted to receive and hold a respective one of the chill molds so that the bottom is elevated relative to the base, and a column extending between the base and the frame.

16. A method of cooling a molten material, comprising:

pouring the molten material in a plurality of chill molds, each of the chill molds having a bottom panel and at least one sidewall rising up from the bottom panel defining together a vessel for holding the molten material therein to form a casting;

aligning the chill molds generally in a row on a plurality of supports, each support having a base that holds the support generally upright on a floor surface and a frame positioned above the base adapted to receive and hold the chill mold so that the bottom panel is elevated relative to the base;

directing a generally horizontal flow of cooling air underneath the chill molds with at least one fan; and diverting the flow of cooling air upwardly so as to impinge on the bottom panels of at least some of the chill molds by using a plurality of baffles arranged underneath the chill molds, each of the baffles having an air flow guiding surface that partially faces the at least one fan and partially faces a bottom panel.

17. The method of claim 16, wherein the step of diverting comprises the flow of cooling air impinging bottoms of the chill molds generally vertically.

18. The method of claim 16, wherein the step of diverting comprises arranging a plurality of baffles underneath some of the chill molds.

19. The method of claim 18, further comprising varying a size of at least one of the baffles relative to the other baffles.

20. The method of claim 19, further comprising varying the size of the at least one of the baffles based on the distance of the baffle relative to a source of the flow of cooling air.

21. The method of claim 18, further comprising varying a vertical position of at least one of the baffles relative to the other baffles.

22. The method of claim 21, wherein the step of varying comprises arranging at least some of the baffles vertically offset from one another so that each diverts a portion of the flow of cooling air while permitting the remaining flow to pass on to the next baffle.

* * * * *